US009791232B1

(12) United States Patent
Winge

(10) Patent No.: US 9,791,232 B1
(45) Date of Patent: Oct. 17, 2017

(54) FIREARM TRIGGER FINGER RESET

(71) Applicant: David A. Winge, Boonville, IN (US)

(72) Inventor: David A. Winge, Boonville, IN (US)

( * ) Notice: Subject to any disclaimer, the term of this patent is extended or adjusted under 35 U.S.C. 154(b) by 0 days.

(21) Appl. No.: 15/247,520

(22) Filed: Aug. 25, 2016

Related U.S. Application Data

(60) Provisional application No. 62/255,723, filed on Nov. 16, 2015.

(51) Int. Cl.
*F41A 19/09* (2006.01)
*F41A 19/10* (2006.01)

(52) U.S. Cl.
CPC ..... *F41A 19/09* (2013.01); *F41A 19/10* (2013.01)

(58) Field of Classification Search
CPC ..... F41A 19/09; F41A 19/10
See application file for complete search history.

(56) References Cited

U.S. PATENT DOCUMENTS 4,276,808 A * 7/1981 York ..... F41A 19/09 89/136
4,532,852 A * 8/1985 Hance ..... F41A 19/09 89/136
5,485,776 A * 1/1996 Ealovega ..... F41A 19/33 89/130
5,890,479 A * 4/1999 Morin ..... F41B 11/00 124/31
6,550,468 B1 * 4/2003 Tippmann, Jr. ..... F41B 11/721 124/31
6,802,305 B1 * 10/2004 Hatcher ..... F41A 19/10 124/31
7,103,999 B2 * 9/2006 Jones ..... F41A 19/09 42/69.01
7,487,768 B2 * 2/2009 Hatcher ..... F41A 11/02 124/31
8,807,007 B2 * 8/2014 Alicea ..... F41A 17/06 89/28.1
9,146,064 B2 * 9/2015 Whittington ..... F41A 19/09
9,644,915 B2 * 5/2017 Alderman ..... F41A 19/59

* cited by examiner

*Primary Examiner* — Stephen Johnson
*Assistant Examiner* — Joshua T Semick
(74) *Attorney, Agent, or Firm* — Gary K. Price

(57) ABSTRACT

A trigger reset that is disposed in a firearm handle including an electric motor, a battery, a gear box and cam lobe mounted on a shaft of the motor. A reset bar assembly is secured to the cam lobe. As shaft turns, cam lobe moves to provide a reciprocating motion to reset bar assembly. The reset bar assembly may be biased in lateral directions via a spring or the like. Rearward movement of the firearm trigger causes movement of the reset bar assembly in a rearward longitudinal direction. When the trigger reset is actuated, the motor rotates the cam lobe moving the reset bar assembly in a forward position thereby urging the trigger to a reset position prior to actuating the next firing sequence. The reset trigger system further includes a switch defining a face portion that is positioned on the exterior surface of the grip and immediately below the trigger for easy accessibility when holding or firing the firearm.

20 Claims, 6 Drawing Sheets

FIREARM TRIGGER FINGER RESET

CROSS REFERENCES TO RELATED APPLICATIONS

U.S. Provisional Application for Patent No. 62/255,723, filed Nov. 16, 2015, with title "Firearm Trigger Reset" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates generally to a trigger mechanism of a firearm, and more specifically, to an external power source for a user's trigger finger reset upon discharge of a firearm.

2. Brief Description of Prior Art

Semi-automatic firearms are well known in the art. Common to this type of firearms is its dependency on a user's ability to continually pull the trigger in a rapid manner when a high rate of fire is desired. Because human fatigue reduces an amount of time that a high rate of fire can be sustained, or physiological impairments may interfere with a user's ability to operate the trigger effectively, there are ongoing efforts to improve firearm design.

As stated, one of the limiting factors of semi-automatic firearms is the user's ability to continually pull the trigger in a rapid manner when higher rates of fire are desired. Human finger speed can be quick for only a short period of time and would not be continually uniform. The use of a fully automatic gun is often cost prohibitive. Fully automatic guns also have complicated internal mechanisms which make them more prone to jamming and breaking and makes them harder to fix. The prior art has not adequately addressed these issues. Therefore, it can be appreciated that there is room in the art for significant improvement on the prior art with regard to the trigger action. The present invention addresses these needs.

The preferred embodiments of the present invention overcome disadvantages of the prior art. In this regard, the present invention discloses a trigger reset that utilizes an external power source for resetting the user's trigger finger after fire. Still other objects will become apparent from the more detailed description which follows.

SUMMARY OF THE INVENTION

A trigger finger reset that is disposed in a firearm handle or grip including an electric motor used with the disclosed trigger reset system. The trigger reset further includes a battery, a gear box and cam lobe mounted on a shaft of the motor. A reset bar assembly is secured to cam lobe. As shaft turns, cam lobe moves to provide a reciprocating motion to reset bar assembly. The reset bar assembly may be biased in lateral directions via a spring or the like. Rearward movement of the firearm trigger causes movement of the reset bar assembly in a rearward longitudinal direction. When the trigger reset is actuated, the motor rotates the cam lobe moving the reset bar assembly in a forward position thereby urging the user's trigger finger to a reset position prior to actuating the next firing sequence.

The reset trigger finger device further includes a switch that is electrically connected to the motor and battery, and is disposed in the grip of the firearm. A face portion of the switch is positioned on the exterior surface of the grip and immediately below the trigger for easy accessibility when holding or firing the firearm. Continually pressing the switch while holding and/or firing the firearm will maintain actuation of the trigger finger reset.

And, releasing the electric switch will deactivate the reset. Thus, while the reset is actuated, the trigger can be depressed and the activated trigger reset will immediately reset the user's trigger finger as described with less effort by the user.

DESCRIPTION OF THE PREFERRED EMBODIMENT

Figure 1:
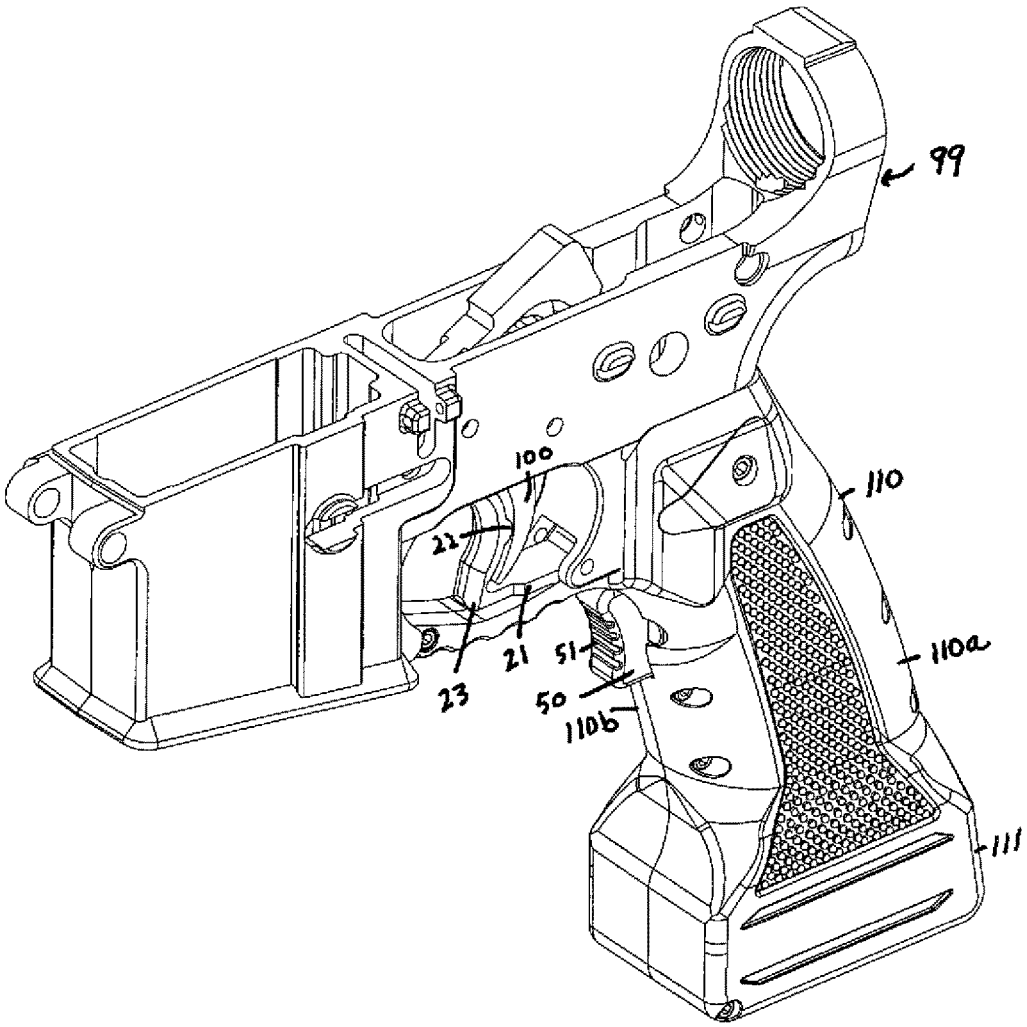
FIG. 1 is a perspective view of a prior art firearm that includes a preferred embodiment of the present invention, a firearm trigger reset.

The mechanism of the present invention is directed to a firearm trigger finger reset that is used with semi-automatic firearms. Unlike the prior art, the firearm trigger finger reset of the present invention defines a trigger reset that utilizes an external power source for resetting the user's trigger finger after fire. As will be described, the firearm trigger finger reset as disclosed further consists of components configured and correlated with respect to each other so as to attain the desired objective.

From the outset, it should be understood that the present invention relates to a trigger finger reset for quickly and continuously resetting the user's trigger finger upon discharge. The present invention does not alter the cycle of operation of firing the semi-automatic firearm which is widely known and again, not altered by the present invention.

A trigger finger reset designated as numeral 10 of the present invention generally includes a reset bar assembly 20 in communication with a reset mechanism 29 that generally includes a cam lobe 25, a gear box 30, a clutch member 45, and a power source 40. The trigger reset 10 also preferably includes an electric motor 35 in electrical connection 36 with power source 40.

In the embodiment illustrated, the reset mechanism 29 is disposed in the firearm's 99 handle or grip 110. In this regard, the firearm's handle 110 includes a molded front and rear casing 110*a*, 110*b*, which can serve as a housing for the trigger reset mechanism 29 and the bar assembly 20. However, it should be understood that the reset mechanism 29 or components of the reset mechanism 29 may be disposed for example in the shoulder stock (not designated) of the firearm 99, or external of the firearm 99.

The electric motor 35 and gear box 30 are standard commercial components. Electric motor 35, for example, is preferably a low voltage DC motor. Power to motor 35 is preferably a battery 40 mounted in a battery mount. Switch 50 is electrically connected 50*a* to motor 35 and battery 40.

The bar assembly 20 is comprised of an arm 21 that defines an extension 23. The opposite end 20*a* of bar assembly 20 terminates adjacent cam lobe 25. During operation, the bar assembly 20 is translated by rotation of the cam lobe 25 and communication between cam lobe 25 and opposite end 20*a*. Rotation of cam lobe 25 is via the electric motor 35. Opposite end 20*a* is preferably a roller assembly that includes a roller axle (not shown) and roller 20*b* configured to engage the cam lobe 25. In particular, the purpose of the roller assembly 20*a* is to roll around the perimeter 25*a* of the cam 25 moving from a high position and to a low position (as will be further discussed), and vice versa. The roller 20*b* reduces friction between the assembly 20*a* and perimeter 25*a*, compared to a non-roller piece.

The gear box 30 is in communication with the motor 35 and cam lobe 25 is mounted on shaft 37 of motor 35 to drive the cam lobe 25. Gear box 30 configured to rotatably position the cam lobe 25 when motor 35 is actuated. Motor 35 and gear box 30 are connected 31 using standard couplings.

Switch 50 is electrically connected 50*a* to the motor 35 and battery 40, and is preferably disposed in the grip 110 of the firearm. As illustrated, a face portion 51 of the switch 50 is positioned on the exterior surface of the grip and immediately below the trigger 100. Preferably, the switch 50 is a pressure sensor.

Figure 5:
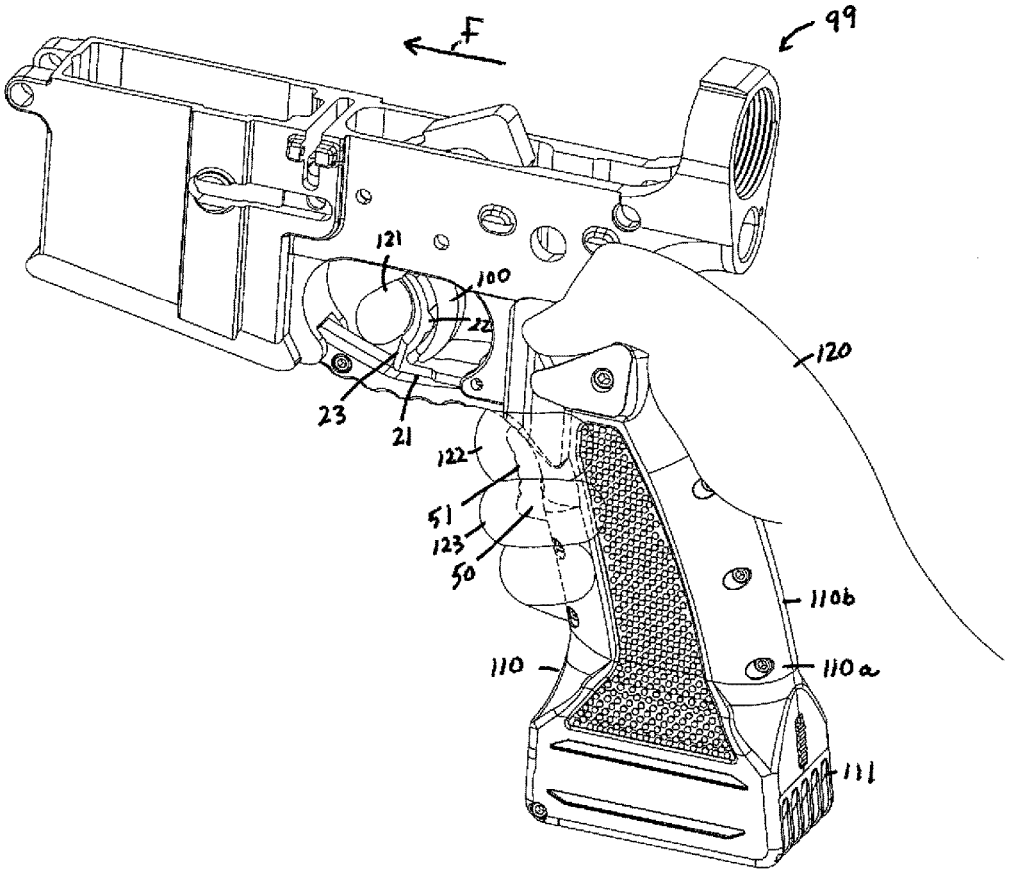
FIG. 5 illustrates the firearm and present invention of FIG. 1 in application.
Figure 6:
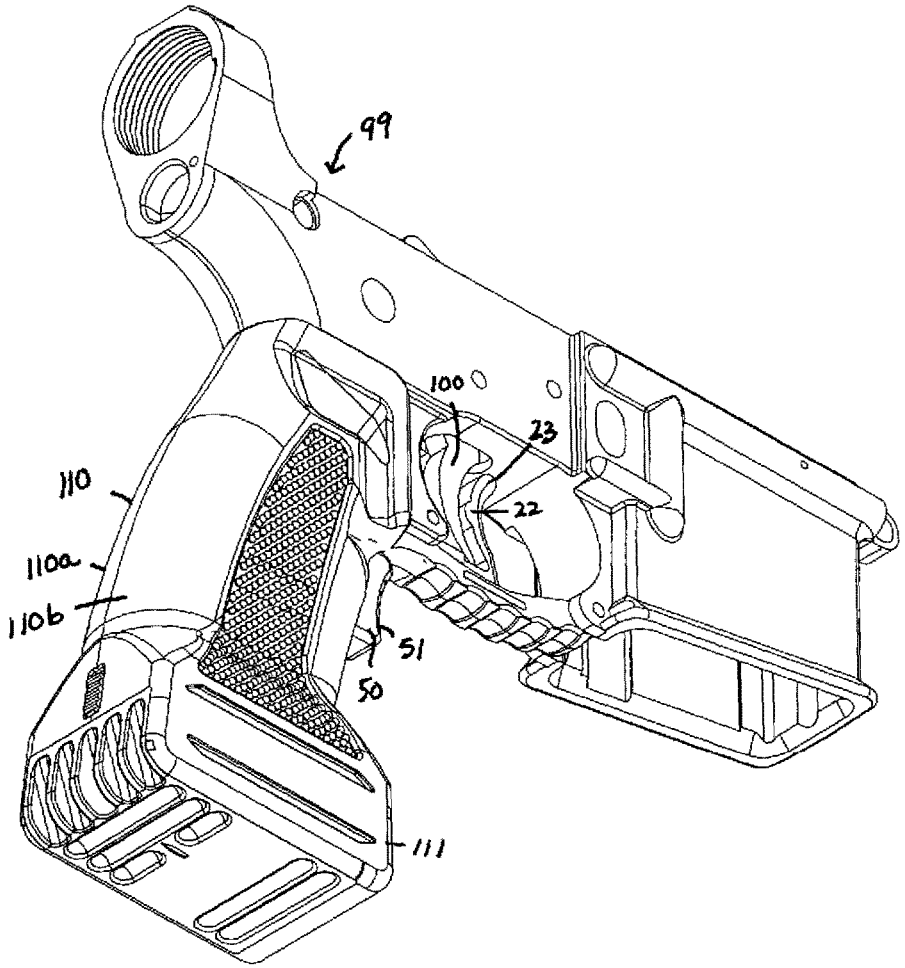
FIG. 6 is a bottom perspective view of the firearm and present invention of FIG. 1.

As is known, when a user fires the firearm, the user generally wraps its hand 120 around the grip 110 of the firearm 99 with the index (trigger) finger 121 positioned against the trigger 100. In this position, and in the preferred embodiment (see FIG. 5), the third 122 or fourth 123 finger then is naturally positioned over the switch 50. Continually pressing the switch 50 while holding and/or firing the firearm will maintain actuation of the trigger reset 10. And, releasing the switch 30 will deactivate the reset 10.

Thus, while the reset 10 is actuated, the trigger 100 can be depressed by the user manually urging the extension 23 in the rearward direction with his/her trigger finger and the activated trigger reset 10 will immediately reset the extension 23 causing the user's trigger finger to be pushed off the extension 23 with little effort by the user. As should be understood, when the trigger 100 is actuated as described, the firearm's own firing mechanism will reset the trigger 100 for firing.

Clutch member 45 is in mechanical communication with the switch 50. A tip 46 of clutch member 45 is in releasable communication with at least one notch 26*a* of the cam lobe 25. In particular, when switch 50 is activated, the clutch member 45 first disengages its hold on cam 25 by releasing tip 46 from notch 26*a*. Such releasing action is accomplished by the face portion 51 of the switch 50 being pulled in a rearward direction by the user's middle finger 122 which causes the camming geometry 125 on top of the face portion 51 of the switch 50 to rotate clutch member 45 and specifically rotating or releasing tip 46 from notch 26*a* of the cam 25.

Figure 4:
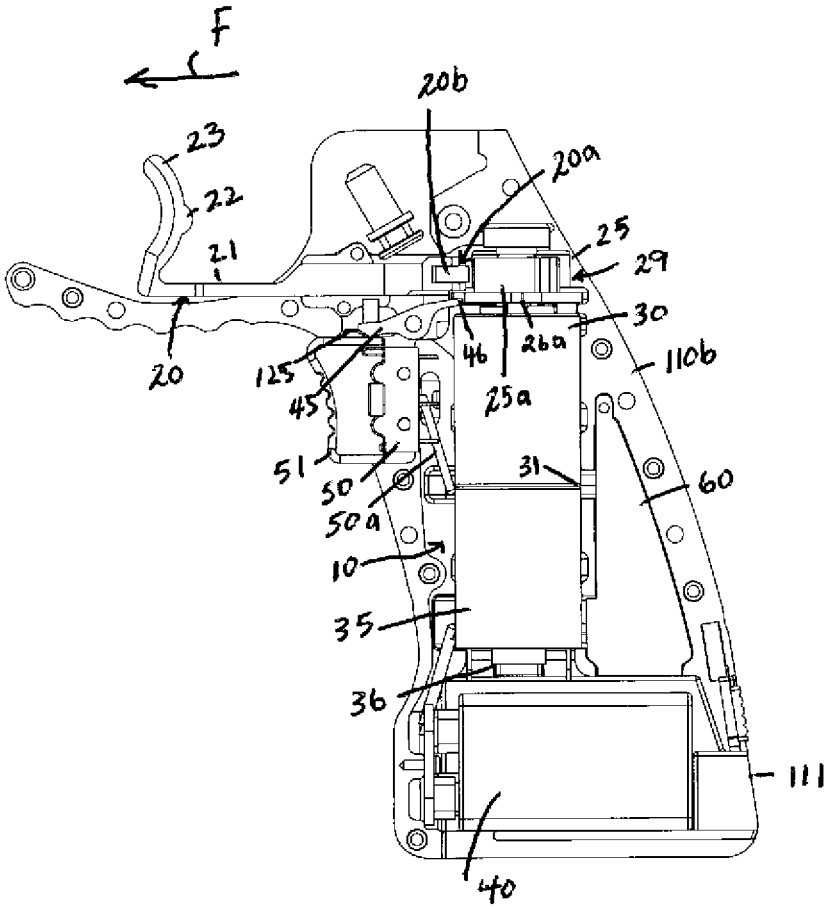
FIG. 4 is a side view of the present invention shown in FIG. 3.

Once released, the motor 35 is able to turn the cam 25. As cam 25 turns, the cam 25 pushes reset bar 20 in a forward motion (see Arrow "F" in FIG. 4 and FIG. 5), pushing the user's trigger finger forward with the extension 23 and off the trigger 100 allowing it to quickly reset and the cycle continues in fractions of a second until the user releases the switch 50.

Cam lobe 25 may be located on and fixed for rotation with shaft 37. As shaft 37 turns, cam lobe 25 moves to provide a reciprocating motion to reset bar assembly 20. More particularly, the gear box 30 and cam lobe 25 generally define a first position and a second position. In the first position, cam lobe 25 is at a first or rest position, and in the second position and upon actuation of the trigger reset 10, the motor rotates cam lobe from the second position to the rest position.

When the cam lobe 25 is in the defined rest position, the extension 23 has been reset as a result of cam 25 making at least a 180 degree rotation, meaning, the roller assembly 20*a* has gone from a low point to a high point back to a low point which occurs every 180 degrees of rotation. The trigger 100 is once again ready to fire, and reset bar 20 is therefore tangent to the firearm trigger 100 as a result of contact point 22 disposed on the extension 23. At this point, roller assembly 20*a* is not in contact with cam 25, there is now a gap (not shown) between cam 25 and roller assembly 20*a* which is caused by the user releasing pressure from his trigger finger 121 and releasing pressure off switch 50 with his middle finger 122.

As described, when activated, and when the cam lobe is in the second position, the motor turns cam lobe to the rest position, which moves the reset bar 20 forward and returns the extension 23 to a reset, ready to fire position.

Figure 2:
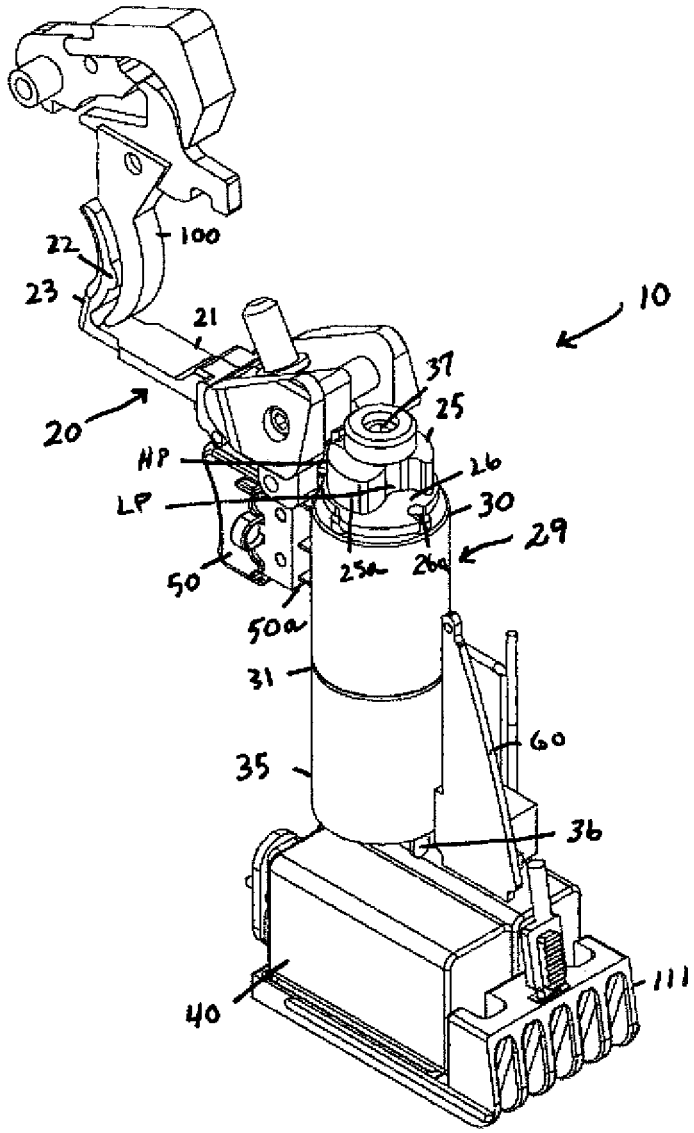
FIG. 2 is a perspective view of the present invention illustrating the positioning of the present invention with respect to a prior art firearm's trigger mechanism.
Figure 3:
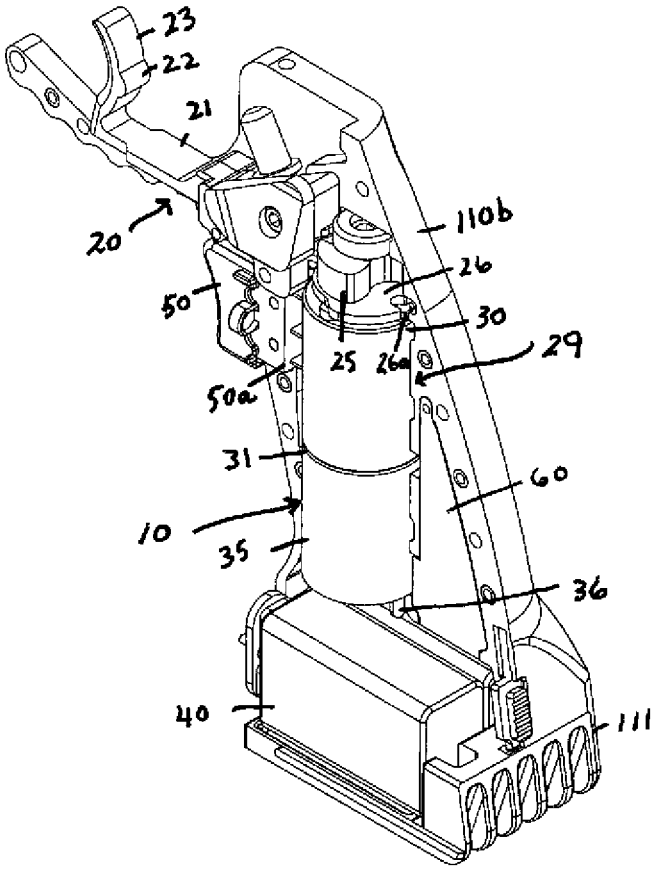
FIG. 3 is a sectional view of a prior art firearm's grip with the present invention disposed therein.

As illustrated, cam lobe 25 includes a bottom plate portion 26 that includes the at least (1) notch 26*a*. In application, the cam lobe 25 defines a high position HP and a low position LP (see FIG. 2). When the reset bar 20 is in the full low position LP (as shown in the drawings) of the cam 25 the device 10 is ready for the user to fire the weapon, and when the roller 20*b* is on the high position of the cam 25, the user is not able to fire the firearm because the reset bar 20 is pushing the user's finger in the forward direction F away from the firearm trigger 100.

When the switch 50 is disengaged, the clutch member 45 is configured to rotate such that the clutch tip 46 is received in notch 26*a* to stop the motor 35 from rotating the cam 25. More particularly, clutch member 45 is configured to allow motor 35 to rotate approximately half a revolution until the reset bar 20 and particularly the roller assembly 20*a* and the cam 25 are returned to the same position (low spot) before the switch 50 was engaged.

Again it should be understood that when the switch 50 is not engaged, the reset bar 20 is in the low position LP and the user is able to take single shots with the firearm without application or engagement of the clutch, motor and cam as described.

In the present non-limiting example, the reset bar assembly 20 is generally perpendicular to the length of the firearm's trigger 100 and defines an extension 23 that is operably engageable with the trigger 100. As illustrated, the extension 23 preferably has a very similar shape and form as the trigger 100 and is aligned in front of and parallel with the trigger 100.

As described, upon operation of the trigger reset 10 via rearward movement of the extension 23, a contact point 22 of the extension 23 engages the firearm's trigger 100.

The reset mechanism 29 is preferably a self-supporting assembly within the housing 110. As illustrated, the housing 110 includes appropriate couplings for securing the mechanism 29 within the housing. The battery 40 is preferably positioned in a base portion 111 of the grip 110. The motor 35 is positioned adjacent the power source 40 with the gear box 30 coupled to the motor 35. The cam lobe 25 coupled with the gear box 30 as described.

The reset bar assembly 20 may be biased in lateral directions via a spring (not shown) or the like. As described, rearward movement of the reset bar's extension 23 causes a reciprocal movement by the trigger 100 in a rearward longitudinal direction. After firing, the trigger reset 10 is actuated such that the motor 35 rotates the cam lobe 25 moving the reset bar assembly 20 in a forward, or the rest position thereby urging the extension 23 to a reset position prior to actuating the next firing sequence.

As illustrated, the trigger reset 10 further includes a printed circuit board assembly 60 that is in electrical communication with the reset mechanism 29. In particular, the assembly 60 is configured to (1) act as a reverse current protection should various acts of user error for example, cause the motor 35 to run in reverse. As may be understood, if the reset device were to mistakenly run in reverse it would likely cause damage to the device including damage to the electric motor 35. The board assembly 60 provides a protection from such damage occurring. (2) The board assembly 60 further serves as a voltage amplifier by taking input voltage from the power source 40 and approximately doubling it after passing through the board assembly 60 giving an approximate 40%-50% input voltage increase to the motor. The inventor has found this voltage amplifier feature critical to the present invention since it is important to achieve the proper revolutions per minute (rpm) for the device to function as desired. (3) The board assembly 60 further serves as a low voltage shut off. Once the power source (battery) 40 can no longer maintain enough voltage input for the board 60 to amplify and run the motor 35 at the desired rpm, the board assembly 60 will automatically stop or shut off power to the device. The inventor has found that the board assembly 60 and electronics described in the reset mechanism 29 can be damaged by low input voltage and the rpm can slow down and not operate the device as intended.

During operation of the firearm, the user can depress the extension 23 urging the trigger in the rearward direction to fire. Depressing switch 50 as described generally results in activation of the device 10, movement of the clutch member 45 and rotation of the cam lobe 25 as described that moves the reset bar in the forward F position. Forcing the reset bar 20 forward as described likewise urges the user's trigger finger forward to a reset position. As such, the reset bar assembly 20 is configured to continuously and forcibly return the extension 23 (and the user's trigger finger) to the trigger's reset after firing.

Although the above description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. For example, although not shown, rather than using a battery for power as illustrated and described, the power source may be some other known power means such as a supply of regulated air pressure from an external source. Thus the scope of the invention should be determined by the appended claims in the formal application and their legal equivalents, rather than by the examples given.

I claim:

1. A trigger finger reset comprising:

a reset bar assembly in communication with a reset mechanism comprising a gear box, a clutch member, a power source, and an electric motor having a shaft, and a cam lobe fixed for rotation with said shaft, said electric motor in electrical connection with said power source, said reset mechanism disposed in a grip of a firearm, a switch in electrical communication with said electric motor, said switch including a face portion positioned on an exterior surface of the grip immediately below a trigger of the firearm, said reset bar assembly having a first end that defines an extension, and an opposite end that defines a roller assembly that terminates adjacent a perimeter of said cam lobe such that rotating said cam lobe provides a reciprocating motion to said reset bar assembly, wherein said extension is aligned in front of and parallel with the trigger and is operably engageable with the trigger, said clutch member is in mechanical communication with said switch, and wherein a tip of said clutch member is releasably received within an at least one notch disposed on a lower plate of said cam lobe such that when said switch is activated said clutch member disengages its hold on said cam lobe releasing said tip from said at least one notch allowing said electric motor to turn said cam lobe and push said reset bar assembly in a forward direction, wherein said cam lobe defines a high position and a low position and when said reset bar assembly is in the low position of said cam lobe said trigger finger reset is positioned for a user to fire the firearm, and when said reset bar assembly is on the high position of said cam lobe the user is not able to fire the firearm since the reset bar assembly is pushing the extension in the forward direction, and when said switch is disengaged said clutch member is configured to rotate such that said tip is received in said at least one notch to stop said cam lobe from rotating, a printed circuit board assembly in electrical communication with said reset mechanism, said printed circuit board assembly including a reverse current protection, a voltage amplifier, and a low voltage shut off.

2. The trigger finger reset of claim 1, wherein said roller assembly includes a roller axle and a roller configured to engage said perimeter of said cam lobe.

3. The trigger finger reset of claim 2, wherein when said switch is disengaged said clutch member is configured to allow said electric motor to rotate approximately half a revolution until said reset bar assembly and said cam lobe are returned to the low position.

4. A trigger finger reset comprising:

a reset bar assembly in communication with a reset mechanism that includes a cam lobe, a gear box, a clutch member, a power source, and an electric motor in electrical connection with said power source, a switch electrically connected to said electric motor and said power source, said reset bar assembly includes an arm that defines an extension, and an opposite end of said reset bar assembly is adjacent said cam lobe, and wherein said gear box is configured to rotatably position said cam lobe relative to said opposite end, wherein said extension is aligned in front of and parallel with a trigger of a firearm and is operably engageable with the trigger, said clutch member is in mechanical communication with said switch, and wherein a tip of said clutch member is in releasable communication with at least one notch disposed in said cam lobe such that when said switch is activated said clutch member disengages its hold on said cam lobe releasing said tip from said at least one notch allowing said electric motor to turn said cam lobe and push said reset bar assembly in a forward direction, wherein said cam lobe defines a high position and a low position and when said reset bar assembly is in the low position of said cam lobe said trigger finger reset is positioned for a user to fire the firearm, and when said reset bar assembly is on the high position of said cam lobe the user is not able to fire the firearm since the reset bar assembly is pushing the extension in the forward direction, and when said switch is disengaged said clutch member is configured to rotate such that said tip is received in said at least one notch to stop said cam lobe from rotating, a circuit board assembly in electrical communication with said reset mechanism, said circuit board assembly is configured to provide reverse current protection.

5. The trigger finger reset of claim 4, wherein said reset mechanism is disposed in a grip of the firearm.

6. The trigger finger reset of claim 4, wherein said opposite end is a roller assembly that includes a roller axle and a roller configured to engage a perimeter of said cam lobe.

7. The trigger finger reset of claim 5, wherein said switch is disposed in the grip.

8. The trigger finger reset of claim 7, wherein a face portion of said switch is positioned on an exterior surface of the grip immediately below the trigger.

9. The trigger finger reset of claim 8, further including a camming member in communication with said switch, said camming member configured to rotate said tip off said at least one notch.

10. The trigger finger reset of claim 4, wherein said cam lobe includes a bottom plate portion that includes said at least one notch.

11. The trigger finger reset of claim 4, wherein when said switch is disengaged said clutch member is configured to rotate a shaft of the electric motor approximately half a revolution until said reset bar assembly and said cam lobe are returned to the low position.

12. The trigger finger reset of claim 4, wherein said circuit board assembly is a voltage amplifier configured for taking input voltage from said power source and increasing voltage to said electric motor.

13. The trigger finger reset of claim 12, wherein said circuit board assembly further configured to shut off said trigger finger reset when said input voltage is insufficient to run said electric motor.

14. A trigger finger reset comprising:

a reset bar assembly, a reset mechanism that includes a cam lobe, a gear box, a clutch member, a power source, and an electric motor in electrical connection with said power source, a switch in electrical communication with said electric motor, said reset bar assembly includes an arm that defines an extension, and an opposite end that defines a roller assembly, wherein said extension is aligned in front of and parallel with a trigger of a firearm and is operably engageable with the trigger, said clutch member is in mechanical communication with said switch, and wherein a tip of said clutch member is releasably received within an at least one notch disposed on said cam lobe such that when said switch is activated a camming member is configured to disengage said tip from said at least one notch allowing said electric motor to turn said cam lobe and push said reset bar in a forward direction, wherein said cam lobe defines a high position and a low position and when said reset bar assembly is in the low position of said cam lobe said trigger finger reset is positioned for a user to fire the firearm, and when said reset bar assembly is on the high position of said cam lobe the user is not able to fire the firearm since the reset bar assembly is pushing the extension in the forward direction, and when said switch is disengaged said clutch member is configured to rotate such that said tip is received in said at least one notch to stop said cam lobe from rotating, a printed circuit board assembly in electrical communication with said reset mechanism.

15. The trigger finger reset of claim 14, wherein said roller assembly includes a roller axle and a roller configured to engage a perimeter of said cam lobe.

16. The trigger finger reset of claim 14, wherein a face portion of said switch is positioned on an exterior surface of a grip of the firearm immediately below the trigger.

17. The trigger finger reset of claim 16, wherein when said switch is disengaged said clutch member is configured to allow said electric motor to rotate approximately half a revolution until said reset bar assembly and said cam lobe are returned to the low position.

18. The trigger finger reset of claim 14, wherein said printed circuit board assembly is a voltage amplifier configured for taking input voltage from said power source and increasing voltage to said electric motor.

19. The trigger finger reset of claim 18, wherein said printed circuit board assembly is configured to shut off said trigger finger reset when said input voltage is insufficient to run said electric motor.

20. The trigger finger reset of claim 19, wherein said printed circuit board assembly is configured to provide reverse current protection.

* * * * *